US005595287A

United States Patent [19]

Niklaus

[11] Patent Number: 5,595,287

[45] Date of Patent: Jan. 21, 1997

[54] SPRING DRIVE FOR A SWITCHING APPARATUS

[75] Inventor: Rolf Niklaus, Unterentfelden, Switzerland

[73] Assignee: GEC Alsthom T & D AG, Oberentfelden, Switzerland

[21] Appl. No.: 328,650

[22] Filed: Oct. 25, 1994

[30] Foreign Application Priority Data

Nov. 3, 1993 [CH] Switzerland ..... 93117797.6

[51] Int. Cl.[6] ..... H01H 3/40

[52] U.S. Cl. ..... 200/501; 74/462; 200/400

[58] Field of Search ..... 200/500, 501, 200/573, 574; 74/462, 435, 2, 39; 185/40 R, 37, 38; 366/260; 173/202, 93.5, 100, 118, 203, 121, 56, 55, 53

[56] References Cited

U.S. PATENT DOCUMENTS

| | | | |
|---|---|---|---|
| 3,072,763 | 1/1963 | Goodwin, Jr. | 200/92 |
| 3,203,505 | 8/1965 | Hannauer | 185/40 |
| 3,220,279 | 11/1965 | Dareing | 74/462 |
| 3,890,853 | 6/1975 | Feltz | 74/435 |
| 4,649,244 | 3/1987 | Baginski et al. . | |
| 4,653,340 | 3/1987 | La Bate | 74/462 |

FOREIGN PATENT DOCUMENTS

| | | | |
|---|---|---|---|
| 208451 | 4/1960 | Austria . | |
| 0294561 | 12/1988 | European Pat. Off. . | |
| 2244613 | 5/1973 | Germany . | |
| 0090752 | 7/1980 | Japan | 74/462 |
| 561956 | 4/1974 | Switzerland . | |
| 1096415 | 6/1984 | U.S.S.R. | 74/462 |
| 1273014 | 9/1969 | United Kingdom . | |

*Primary Examiner*—Renee S. Luebke
*Attorney, Agent, or Firm*— Keck, Mahin & Cate

[57] ABSTRACT

A spring drive for an electrical switching apparatus has a switch-on shaft to which a switch-on spring is coupled eccentrically and on which a large wheel (16) is seated in a rotationally fixed manner. A small wheel (20), which is driven in order to stress the switch-on spring, interacts with the large wheel (16). A tooth system (52) on the large wheel (16) has a gap (54) for decoupling the wheel pair (18) formed by large wheel (16) and small wheel (20) when the switch-on spring is stressed. In order to connect the switching apparatus, the large wheel (16) is driven in a rotation direction (D), as a result of which the tooth system (52) engages with the small wheel (20) again. In order to prevent blocking when the teeth engage in one another, the teeth (60) on the small wheel (20) are constructed in such a manner that the edges (56, 58) abut against one another radially on an outer side at a common edge (62).

8 Claims, 2 Drawing Sheets

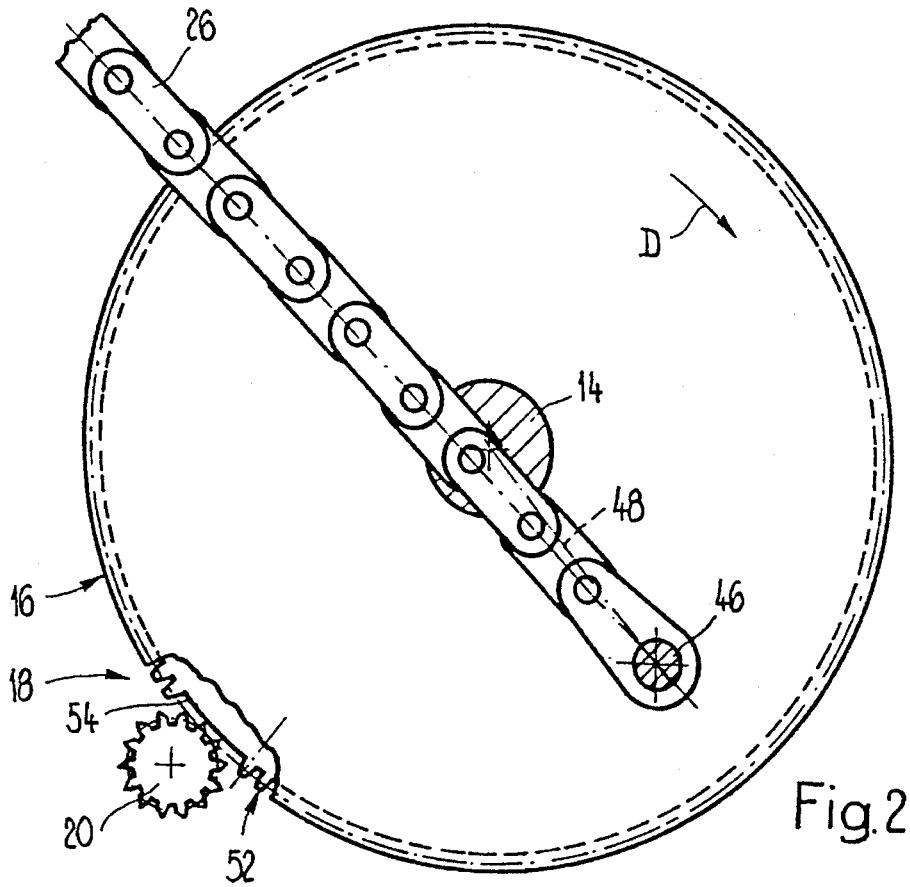
Fig.2
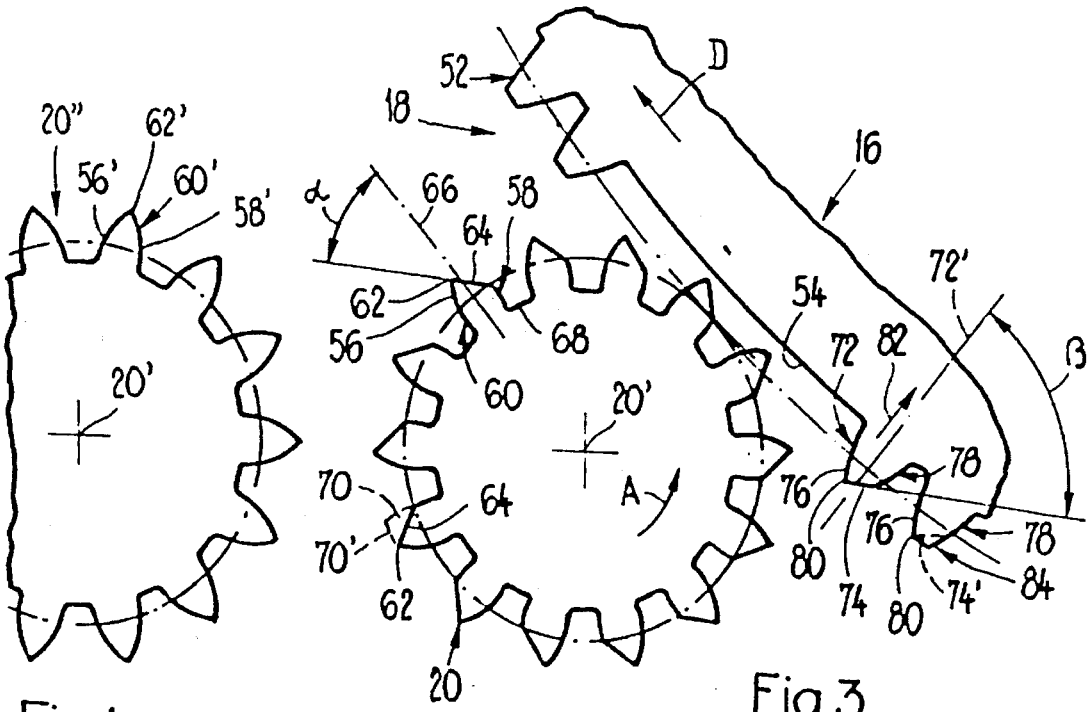
Fig.4
Fig.3

SPRING DRIVE FOR A SWITCHING APPARATUS

FIELD OF THE INVENTION

The invention relates to a spring drive for a switching apparatus, especially a power circuit breaker for medium voltage and high voltage.

BACKGROUND OF THE INVENTION

A spring drive of this type is disclosed in EP-A-0,294,561. A large wheel is seated in a rotationally fixed manner on a rotatably mounted switch-on shaft, on which large wheel a lug is articulated eccentrically with respect to the rotation axis of the switch-on shaft, which lug is connected at the other end to a lever which, for its part, interacts with a switch-on spring which is constructed as a torsion bar. In order to stress the switch-on spring, the large wheel engages with a small wheel which is driven by a drive device in order to drive the switch-on shaft from an original position, in which the switch-on spring is at least partially relieved of stress, via a deadpoint position, in which the line in which the lug acts passes through the rotation axis and in which the switch-on spring is stressed, in the rotational direction. A latching device supports the switch-on shaft in a supported position against the effect of the stressed switch-on spring, which supported position is offset through a small angle in the rotation direction with respect to the deadpoint position. The toothed rim of the large wheel has a tooth gap at that point which is arranged close to the small wheel in the case of a switch-on shaft which is supported on the latching device. This is to prevent the large wheel being driven even further by the small wheel when the switch-on spring is stressed and thus additionally loading the latching device. In order to switch the switch on, the latching device releases the switch-on shaft, which is driven in the rotation direction under the force of the switch-on spring. At the same time, the toothed rim of the large wheel engages with the small wheel again. In order to prevent the first tooth of the large wheel which follows the gap in the rotation direction of the switch-on shaft resting on the tangential apex surface of a tooth of the small wheel and thus preventing the wheel pair from further rotation, and the spring drive in consequence being blocked, the said first tooth is constructed such that it can be forced back in a sprung manner in the radial direction. If, at switching-on, this tooth abuts against the apex of a tooth on the small wheel, it can give way backwards in the direction of the center of the large wheel and thus slide away over the apex surface of the relevant tooth of the small wheel. It then engages in the gap after this tooth on the small wheel and thus synchronizes the small wheel with the large wheel. In the case of this known spring drive, there is a risk that the tooth which is arranged such that it can give way in a sprung manner drives the small wheel as a result of friction. The second, unsprung tooth, following the gap, of the large wheel can then abut against the apex surface of a further tooth of the small wheel and thus block the drive. This risk occurs especially when the small wheel is decoupled from the drive device by means of a free wheel and can therefore easily be rotated. Furthermore, production of the large wheel with a sprung tooth is costly.

SUMMARY OF THE INVENTION

An object of the present invention is therefore to create a spring drive of the generic type which is prevented from blocking by means of simple measures.

Since the edges of the teeth of the small wheel abut against one another radially externally in a common flank, the teeth have no tangential apex surfaces against which the tooth first following the gap in the large wheel could abut.

In a particularly preferred embodiment of the spring drive according to the invention, the friction losses are minimal, since the teeth of the small wheel, which is driven in order to stress the switch-on spring, have an involute shape on the loaded edge which leads when seen in the rotation direction. An edge plane which is inclined to form a radial straight line can be produced in a simple manner, for example by grinding. This embodiment of the small wheel enables the use of a commercially available gear wheel having an involute tooth system, in the case of which gearwheel the tangential apex surface is removed by producing the inclined flank plane.

A further preferred embodiment of the spring drive according to the invention makes possible simple production of the small wheel, minimal friction losses being achieved in operation. In order to avoid tangential apex surfaces on the teeth, the involute profiles of the flanks are displaced during production such that the flanks abut against one another at a common edge.

A further particularly preferred embodiment of the spring drive according to the invention also prevents a tooth on the small wheel being able to rest on the tangential apex surface of the first tooth following the gap in the large wheel. Even though it is somewhat unlikely, this could occur if the latching device enables the switch-on shaft to switch on immediately after the switch-on spring is stressed, when the small wheel is still slowing down.

A further preferred embodiment of the spring drive according to the invention makes possible the use of a large wheel having an involute tooth system, which large wheel need be reworked only to form the gap and to apply the inclined flat flank part on the first tooth following the gap.

A further, likewise preferred, embodiment of the spring drive according to the invention is somewhat costly to produce but leads to extremely high reliability of the spring drive.

BRIEF DESCRIPTION OF THE DRAWINGS

The present invention is now explained in more detail with reference to the exemplary embodiments illustrated in the drawings in which, purely schematically:

FIG. 2 shows an end view of a wheel pair of the spring drive shown in FIG. 1, the large wheel, which is seated in a rotationally fixed manner on a switch-on shaft and is connected to a switch-on spring, being located in a supporting position in which the switch-on spring is stressed and the switch-on shaft is supported on a latching device.

FIG. 3 shows, enlarged in comparison with FIG. 2, the small wheel in a first embodiment, and a part of the large wheel.

FIG. 4 shows a further embodiment of the small wheel.

DETAILED DESCRIPTION OF THE PREFERRED EMBODIMENTS

Figure 1:
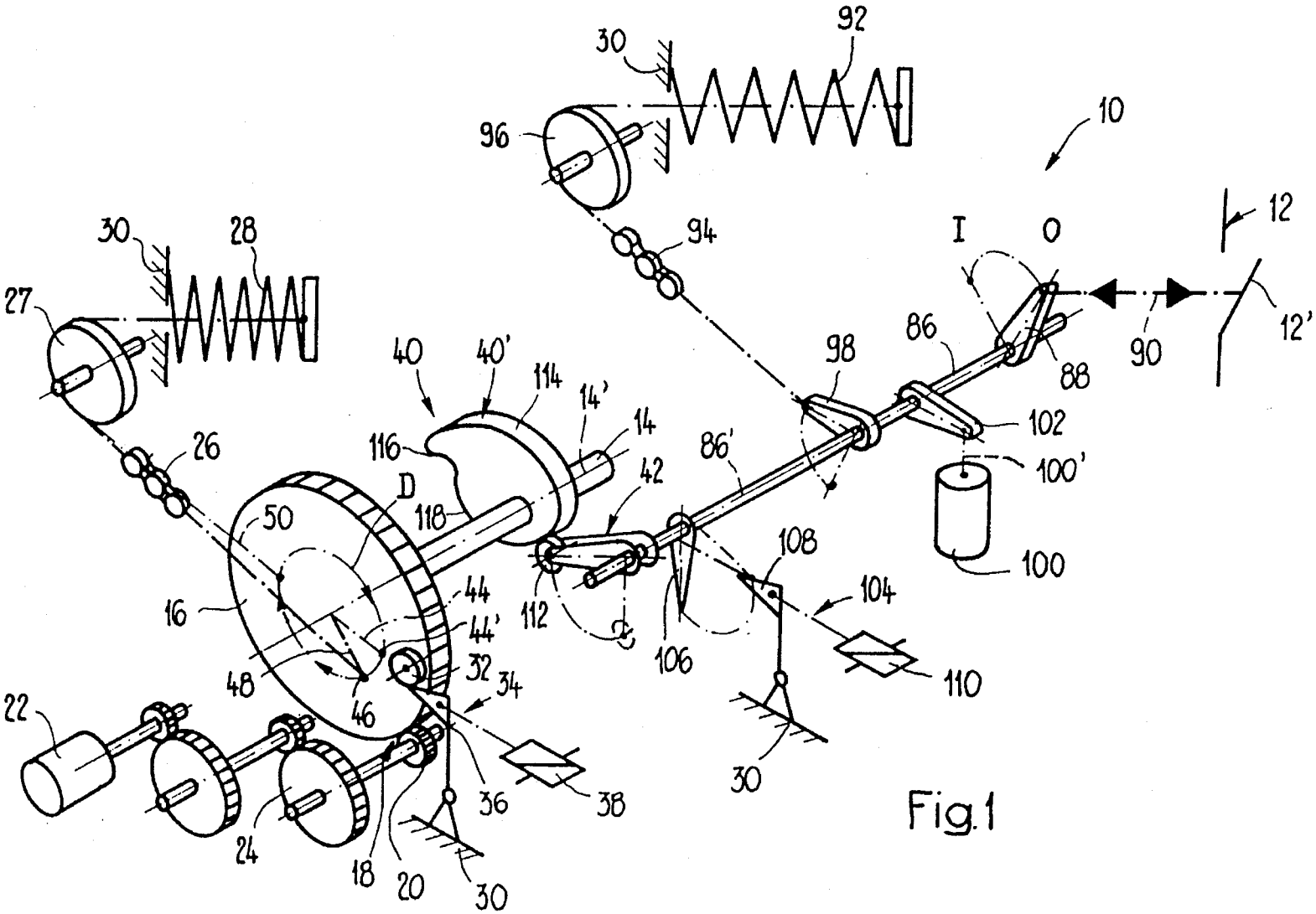
FIG. 1 shows a simplified perspective illustration of a spring drive according to the invention.

A spring drive 10, which is shown in FIG. 1, for a schematically indicated power circuit breaker 12 has a switch-on shaft 14 which is mounted such that it can rotate freely, in a generally known manner, on a framework 30 which is shown only by way of indication, the rotation axis of which switch-on shaft 14 is designated by 14'. A large wheel 16 of a wheel pair 18 is seated in a rotationally fixed manner on said switch-on shaft 14, at one end, the small wheel 20 of which wheel pair 18 is connected to an electric drive motor 22 via a step-down transmission 24.

The end of a chain 26 is articulated on the large wheel 16, on the side facing away from the switch-on shaft 14 and eccentrically with respect to the axis 14', which chain 26 is passed around a guide wheel 27, which is likewise mounted on the framework 30 such that it can rotate freely, and through a switch-on spring 28 which is constructed as a helical compression spring. At its end on this side, the chain 26 is attached to the free end of the switch-on spring 28, which is supported at the other end on the framework 30.

Furthermore, a supporting roller 32 is mounted rotatably on the large wheel 16, on its end face, and is intended to interact with a latching device 34 which is arranged on the framework 30. The latter has a switching-on latch 36 which is mounted on the framework 30 such that it can pivot and can be moved by means of an electrical switch-on magnet 38 from an operating position, which is shown in FIG. 1 and in which it interacts with the supporting roller 32, into a release position, located outside the movement path of the supporting roller 32, and back again.

Furthermore, a cam disk 40, which interacts with a roller lever 42 in order to switch the power circuit breaker 12 on, is seated in a rotationally fixed manner on the switch-on shaft.

A radial line 44, which originates from the axis 14' and is shown by dashed-dotted lines, indicates a dead-point position of the switch-on shaft 14 in which the articulation of the chain 26 is located at 44' on the large wheel 16, the switch-on spring 28 is stressed to the maximum extent, and the line in which the chain 26 acts runs through the axis 14'. In FIG. 1, the switch-on shaft 14 is located in the supported position which follows the dead-point position 44 in the rotation direction D indicated by arrows and is displaced with respect to said dead-point position 44 through an angle which preferably measures several degrees. In the supported position, indicated by the dashed-dotted line 48, the stressed switch-on spring 28 acts on the switch-on shaft 14 in the rotation direction D, said switch-on shaft 14 being prevented from rotating by the supporting roller 32 being supported on the switching-on latch 36.

A further dashed-dotted line indicates a quiescent position 50 of the switch-on shaft 14, which position is diametrically opposite the dead-point position 44 and in which the switch-on spring 28 is at least partially relieved of stress.

FIG. 2 shows the wheel pair 18, the switch-on shaft 14 being located in the supported position 48. Likewise shown is the end region of the chain 26 on this side, with its articulation 46 on the large wheel 16. The tooth system 52 of the large wheel 16 has a gap 54 at that point at which a small wheel 20 is arranged when the switch-on shaft 14 is located in the supported position 48. The gap 54 has an extent which is sufficiently large that, in the supported position 48, the small wheel 20 can rotate freely with respect to the large wheel 16.

FIG. 3 shows a part of the large wheel 16 enlarged, with the gap 54 in the tooth system 52, and the small wheel 20. The flanks 56 and 58 of the teeth 60 of the small wheel 20 abut against one another radially on the outside at an edge 62 which runs parallel to the rotation axis 20'. In order to stress the switch-on spring 28, the small wheel 20 which engages with the tooth system 52 is driven in the drive direction A by means of the drive motor 22, as a result of which the large wheel 16 is rotated in the direction D. The front flank 56 of the teeth 60 of the small wheel 20, which flank is loaded in this case and leads when seen in the drive direction, has an involute shape towards the edge 62. The flank 58 of the teeth 60, which is unloaded when the switch-on spring 28 is stressed and trails when seen in the drive direction A, has a flank plane 64 which abuts against the flank 56 at the edge 62 and is inclined through an angle $\alpha$ of preferably 45° with respect to a radial straight line 66 through the center of the relevant tooth 60. Adjacent to the flank plane 64, the flank 58 exhibits the remaining part of an involute in each case, as far as the root 68.

The small wheel 20 which is shown in FIG. 3 is manufactured from a commercially available gearwheel having an involute tooth system. From this, a part 70, which is indicated by a dashed-dotted line, is removed on each tooth, preferably by grinding, in order to form the flank plane 64. The edge 62 produced in this way is located in the region of the transition from the flank 56 into the tangential end surface 70' of the involute tooth system.

The tooth system 52 of the large wheel 16 also has an involute shape, a flat flank part 74 being integrally formed, likewise preferably by grinding, on the first tooth 72 which trails the gap 54 when seen in the rotation direction D, so that the flanks 76 and 78 of this tooth 72 abut against one another at a common tooth edge 80 which runs parallel to the axis 14'. In this case, the flank 76 which leads when seen in the rotation direction D has an involute shape towards the tooth edge 80. At the tooth edge 80, the flat flank part U4 of the trailing flank 78 abuts against the flank 76, the flat flank part 74 being inclined through an angle $\beta$, preferably of approximately 60°, with respect to a radial straight line 72' through the center of the tooth 72.

A gear wheel having an involute tooth system can likewise be used for the production of the large wheel 16. The required number of teeth to form the gap 54 are removed, for example by grinding. Furthermore, the flat flank part 74 is integrally formed on the tooth 72, in the same manner as that described further above with reference to the small wheel 20.

As a further embodiment of the large wheel 16 it is possible to arrange the tooth 72, as is indicated by the arrow 82, in the body of the large wheel 16 such that it can be forced back in a sprung manner. In this case, a flat flank part 74, as is described further above with reference to the tooth 72, is likewise integrally formed preferably on the second tooth 84 trailing behind the gap 54.

In the case of the small wheel 20" which is shown in FIG. 4, the flanks 56' and 58' of all the teeth 60' have an involute shape, in each case abutting against one another, however, at an edge 62' running parallel to the axis 20'. The small wheel 20" which is shown in this figure can be used instead of the small wheel 20 which is shown in the figure.

Starting from the quiescent position 50, which is indicated in FIG. 1, of the switch-on shaft 40, the large wheel is driven by means of the drive motor 22, via the step-down transmission 24 and the small wheel 20 which engages with the tooth system 52 on the large wheel 16, in the rotation direction D in order to stress the switch-on spring 28. As soon as the dead-point position 44 is passed, the stressed switch-on spring 28 likewise acts on the switch-on shaft 14 in a driving manner in the rotation direction D. However, the switch-on shaft 14 is prevented from rotating further by the supporting roller 32 running into the switching-on latch 26 which is located in the quiescent position. After the deadpoint position 44 has been passed and before reaching the supported position 48, the small wheel 20 disengages from the tooth system 52 on the large wheel 16, since the gap 54 has moved into the region of the small wheel 20. In consequence, the latching device 34 is loaded only by the force produced by the switch-on spring 28. This supporting force is small even when the switch-on spring 28 is stressed with a large force, because of the supported position 48, which is located close to the dead-point position 44. This all allows the latching device 34 to be designed for small forces. The mass to be moved, which is in consequence small, of the latching device 34 allows the reaction time of the spring drive 10 to be reduced. Any additional load on the latching device 34 is avoided by the driven or running-down small wheel 20. For completeness, it should be mentioned that the drive motor 22 is switched off via generally known switching means when the switch-on spring 28 is stressed.

If the switching-on latch 36 is now pulled back, by means of the switch-on magnet 38, from its quiescent position shown in FIG. 1 into the release position in order to switch the power circuit breaker 12 on, the switch-on spring 28 accelerates the switch-on shaft 14 in the rotation direction D. In consequence, the first tooth 72 following the gap 54 on the large wheel 16 runs onto the flank 58 of that tooth 60 on the small wheel 20 which projects most to the rear in the movement path of the tooth 72 when seen in the rotation direction A, as a result of which this small wheel 20 is accelerated and engages with the tooth system 52 on the large wheel 16. The special shape of the flank 58 of the teeth 60 on the small wheel 20, which special shape is described further above, is achieved by the leading flank 76 of the tooth 72 always acting, irrespective of the rotation position of the small wheel 20, on a region of the flank 58 which runs approximately parallel to the flank 76 and includes a very small acute angle with it. If, when the latching device 34 is released, the small wheel 20 were to rotate at a considerably greater circumferential speed that the large wheel 16 achieves when the first tooth 72 trailing behind the gap 54 runs into the region of interaction with the small wheel 20, the flat flank part 74 prevents a tooth 60 on the small wheel 20 being able to stop the wheel pair 18 in a blocking manner on the tooth 72, since its flat flank part 74 runs approximately parallel to the radially outer end region of the flank 56 of the relevant tooth 60 of the small wheel 20.

If the drive motor 22 were not to be stopped when the switch-on spring 28 is stressed, for example as a result of a defect, the embodiment of the large wheel 16, in the case of which the first tooth 72 following the gap is constructed such that it can be forced back in the radial direction, ensures smooth non-jerking mutual engagement of the tooth system 52 on the large wheel 16 with the small wheel 20.

The method of operation described above is also achieved using a small wheel 20" in accordance with FIG. 4.

The force of the switch-on spring 28 moves the switch-on shaft 14 back into the quiescent position 50, with the small wheel 20 also rotating and the power circuit breaker 12 being connected.

That part of the spring drive 10 which is connected downstream of the switch-on shaft 14 will now be described, with reference to FIG. 1. The roller lever 42 is seated in a rotationally fixed manner on a drive shaft 86 which is likewise mounted rotatably on the framework 30, the longitudinal axis 86' of which drive shaft 86 runs parallel to the axis 14', and which drive shaft 86 can be pivoted from a disconnected position "O", which is shown by solid lines, into a connected position "I" and back again. An output lever 88, which is seated in a rotationally fixed manner on the drive shaft 86, is connected via a linkage 90, which is indicated by dashed-dotted lines, to the moving switch contact piece 12' of the power circuit breaker 12.

A switch-off spring 92, which is constructed as a compression spring, is supported on the framework 30, the other end of which switch-off spring 92 interacts with a switch-off chain 94 which is passed around a guide wheel 96, which is mounted in a fixed position on the framework 30, to a switch-off lever 98 which is seated in a rotationally fixed manner on the drive shaft 86. When the drive shaft 86 is in the connected position "I", the switch-off lever 98 on which the switch-off chain 94 is articulated is in a position running approximately at right angles to the switch-off chain 94 while, in contrast, in the disconnected position "O", the switch-off lever 98 and the switch-off chain 94 include an obtuse angle in such a manner that the switch-off spring 92 holds the drive shaft 86 in the disconnected position "O", which position is defined by a stop in a braking element 100, against which the braking piston 100' rests in the disconnected position "O", which braking piston 100' is connected to the drive shaft 86 via a braking lever 102.

Furthermore, a switch-off latching device 104 is arranged on the framework 30, which device is of identical construction to the latching device 34 but interacts with a supporting lever 106 which is seated in a rotationally fixed manner on the drive shaft 86. When the drive shaft 86 is in the connected position "I", the supporting lever 106 is supported on the switch-off latch 108 against the force of the switch-off spring 92, which switch-off latch 108 releases the drive shaft 86, driven by an electrical switch-off magnet 110, in order to switch the power circuit breaker 12 off.

A roller 112 which interacts with the cam track 40' on the cam disk 40, is mounted on the free end of the roller lever 42 such that it can rotate freely. The cam track 40' has a first section 114 with a radius which increases against the rotation direction D. This first section 114 extends over an angular range which is slightly smaller than the angle which the switch-on shaft 14 passes through from the supported position 48 into the quiescent position 50 during switch-on. In this rotation range of the switch-on shaft 14, the first section 114 interacts with the roller lever 42 in order to pivot the drive shaft 86 from the disconnected position "O" into the connected position "I". Seen in the direction opposite to the rotation direction D, the first section 114 is followed by an abruptly dropping second section 116 which, when the switch-on shaft 14 is in the quiescent position 50, allows the roller 112 to move from the connected position "I" into the disconnected position "O" without touching the cam disk 40. Seen in the direction opposite to the rotation direction D, the second section 116 is followed by a third section 118 which extends as far as the first section 114, runs approximately coaxially with respect to the axis 14' and whose radius is such that the drive shaft 86, which is in any event in the disconnected position "O", remains in its rotational position during rotation of the switch-on shaft 14 from the quiescent position 50 into the supported position 48.

In FIG. 1, solid lines are used to show the situation in which the switch-on shaft 14 is in the supported position 48 when the switch-on spring 28 is stressed, and the drive shaft 86 is rotated into the disconnected position "O" when the switch-off spring 92 is at least partially relieved of stress. In this case, the power circuit breaker 12 is opened. In order to initiate a switch-on process, the switch-on magnet 38 is now energized, as a result of which the latching device 34 releases the switch-on shaft 14. The latter starts to rotate in the rotation direction D as a result of the force of the switch-on spring 28, as a result of which, on the one hand, as described further above, the tooth system 52 on the large wheel 16 now engages with the small wheel 20 and, on the other hand, the drive shaft 86 is pivoted from its disconnected position "O", in the counterclockwise direction, in the direction towards the connected position "I", by means of the first section 114. Shortly before the switch-on shaft 14 reaches the quiescent position 50, the drive shaft 86 is pivoted into the connected position "I" and the switch-off latching device 104 engages under the supporting lever 106 so that the drive shaft 86 remains in the connected position "I" when the first section 114 has run off the roller 112 and the switch-on shaft 14 is in the quiescent position 50. The connected power circuit breaker 12 can now be switched off at any time by energizing the switch-off magnet 110, since the switch-off spring 92 has also been stressed by the rotation of the drive shaft 86 during switch-on and its energy is now available for switching off. As soon as the switch-on shaft 14 has reached the quiescent position 50, the drive motor 22 is switched on in order to rotate the switch-on shaft 14, via the mutually engaging wheel pair 18, from the quiescent position 50 beyond the dead-point position 44 and at the same time to stress the switch-on spring 28 so that, once it has been raised, the switch-on shaft 14 is in the supported position 48 again, ready for the next switch-on. After passing the dead-point position 44, the drive motor 22 is switched off again and can now run down, since the wheel pair 18 is disengaged, without stressing the latching device 34. If the power circuit breaker 12 is switched off, being driven by the switch-off spring 92, by energizing the switch-off latching device 104, the spring drive 10 is immediately ready for reconnection of the power circuit breaker and simultaneous stressing of the switch-off spring 92.

The energy stored in the switch-on spring 28 is, of course, dimensioned in such a manner that a sufficient amount of excess energy remains after the power circuit breaker 12 has been connected and the switch-off spring 92 has simultaneously been stressed, to ensure that the quiescent position 50 is reached or passed.

Where applicable, excess energy is recuperated in the switch-on spring. It is thus necessary to connect the small wheel 20 to the step-down transmission 24 via a freewheel acting in the drive direction A, so that the drive motor 22 and the step-down transmission 24 are operatively connected only for driving the switch-on shaft 14 and for stressing the switch-on spring 28. If the large wheel 16 then drives the small wheel 20 during switch-on, the latter is decoupled from the drive motor 22 and the step-down transmission 24 so that only the small wheel 20 need be synchronized and moved with the large wheel 16, which leads to small forces because of the low mass.

Instead of the drive motor 22, a hand crank or another drive means can, of course, also be used. The spring force drive 10 according to the invention is particularly suitable for driving medium-voltage and high-voltage switching apparatuses.

The removal and inclining of the teeth 60, 72, 84 can be carried out by grinding. The teeth 60 on the small wheel 20 and the first and possibly second teeth 72, 84, which trail behind the gap 54, on the large wheel 16 are preferably hardened on the edge layer once they have been inclined, that is to say after production of the flank plane 64 or of the flat flank part 74 respectively.

In the exemplary embodiment shown, the wheel pair 18 comprises spur gears. It is, of course, also conceivable for other types of gearwheels to be used.

What is claimed is:

1. A spring drive for a switching apparatus for medium voltage and high voltage, said spring drive comprising:

a switch-on spring which is coupled eccentrically to a rotatably mounted switch-on shaft for driving the switch-on shaft in a rotation direction to switch on the switching apparatus, a large wheel which is connected to the switch-on shaft, a small wheel which interacts with said large wheel and can be driven by means of a drive device in order to stress the switch-on spring by rotation of the switch-on shaft in the rotation direction from an initial position in which the switch-on spring is at least partially relieved of stress, via a deadpoint position in which the switch-on spring is stressed, and a latching device which supports the switch-on shaft in a supported position which follows the deadpoint position in the rotation direction and releases the switch-on shaft to switch on the switching apparatus, the large wheel comprising a first tooth system having a gap at a point which is arranged adjacent to the small wheel when the switch-on shaft is supported on the latching device, the large wheel and the small wheel forming a wheel pair, the small wheel comprising a second tooth system, each tooth of said second tooth system comprising flanks converging toward one another radially on an outer side to a common edge for preventing mutual blocking of the large wheel and the small wheel after release of the switch-on shaft by the latching device, wherein flanks of a first tooth on the large wheel, which trails behind the gap in the rotation direction, converge toward one another radially on an outer side to a common tooth edge, and the first tooth trailing behind the gap has an involute shape on the flank which is loaded during switch on, and the flank which is unloaded during switch on has a flat flank part which converges toward the common tooth edge and is inclined with respect to a radial straight line through a center of the tooth.

2. A spring drive as claimed in claim 1, wherein each tooth of said second tooth system has an involute shape on a flank which is loaded in order to stress the switch-on spring, and a flank, which is unloaded during stressing the switch-on spring, has a flank plane which abuts the common edge and is inclined with respect to a radial straight line through a center of the respective tooth.

3. A spring drive as claimed in claim 2, wherein the flank plane is inclined at an angle of approximately 45° with respect to a radial straight line through a center of the tooth.

4. A spring drive as claimed in claim 1, wherein the flanks of the teeth on the small wheel have an involute shape.

5. A spring drive as claimed in claim 1, wherein the flat flank part is inclined at an angle of approximately 60° with respect to the radial straight line through the center of the tooth.

6. A spring drive as claimed in claim 1, wherein said first tooth on the large wheel is hardened on an edge layer.

7. A spring drive as claimed in claim 6, wherein a second tooth on the large wheel, trailing behind said gap is hardened on an edge layer.

8. A spring drive as claimed in claim 1, wherein the teeth on the small wheel are hardened on an edge layer.

* * * * *